US010272691B2

(12) United States Patent
Kornilovich et al.

(10) Patent No.: US 10,272,691 B2
(45) Date of Patent: Apr. 30, 2019

(54) MICROFLUIDIC SYSTEMS AND NETWORKS

(71) Applicant: Hewlett-Packard Development Company, L.P., Houston, TX (US)

(72) Inventors: Pavel Kornilovich, Corvallis, OR (US); Alexander Govyadinov, Corvallis, OR (US); David P. Markel, Albany, OR (US); Erik D. Torniainen, Maple Grove, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 236 days.

(21) Appl. No.: 15/205,900

(22) Filed: Jul. 8, 2016

(65) Prior Publication Data

US 2016/0318015 A1 Nov. 3, 2016

Related U.S. Application Data

(63) Continuation of application No. 13/698,064, filed as application No. PCT/US2011/021168 on Jan. 13,
(Continued)

(51) Int. Cl.
*F04B 19/20* (2006.01)
*B41J 2/18* (2006.01)
(Continued)

(52) U.S. Cl.
CPC ..... *B41J 2/18* (2013.01); *B01L 3/50273* (2013.01); *B01L 3/502715* (2013.01);
(Continued)

(58) Field of Classification Search
CPC ..... B01L 3/50273; B01L 3/502746; B01L 3/502715; B01L 2400/0481;
(Continued)

(56) References Cited

U.S. PATENT DOCUMENTS 3,552,207 A 1/1971 Monk et al.
3,856,467 A 12/1974 Picker
(Continued)

FOREIGN PATENT DOCUMENTS

CA 2444525 4/2004
CN 1498761 5/2004
(Continued)

OTHER PUBLICATIONS

Nguyen, et al. "A Stepper Micropump for Ferrofluid Driven Microfluidic Systems"; http://www.bentham.org/mns/samples/mns%201-1/0004MNS.pdf > Publication Date: 2009; On pp. 17-21; Nam-Trung Nguyen et al.
(Continued)

*Primary Examiner* — Patrick Hamo
(74) *Attorney, Agent, or Firm* — HP Inc. Patent Department

(57) ABSTRACT

A network of microfluidic channels may include at least three loops interconnected at a junction. Each of the loops may include a fluid channel having a length extending from the junction to a second end; and a fluid actuator along the fluid channel and located at a first distance from junction along the length of the fluid channel and at a second distance less than the first distance from the second end. Activation of the fluid actuator of selected ones of the at least three loops may selectively produce net fluid flow in different directions about the loops. In one implementation, a fluid channel having a fluid actuator may have a bridging portion that extends over another fluid channel.

12 Claims, 12 Drawing Sheets

Related U.S. Application Data

2011, now Pat. No. 9,395,050, which is a continuation-in-part of application No. PCT/US2010/035697, filed on May 21, 2010.

(51) Int. Cl.

| | |
|---|---|
| ***B41J 2/14*** | (2006.01) |
| ***B41J 2/175*** | (2006.01) |
| ***B01L 3/00*** | (2006.01) |
| ***F04B 19/00*** | (2006.01) |
| ***F04B 19/24*** | (2006.01) |

(52) U.S. Cl.

CPC ..... *B01L 3/502746* (2013.01); *B41J 2/1404* (2013.01); *B41J 2/14201* (2013.01); *B41J 2/1753* (2013.01); *F04B 19/006* (2013.01); *F04B 19/20* (2013.01); *F04B 19/24* (2013.01); *B01L 2300/088* (2013.01); *B01L 2300/0816* (2013.01); *B01L 2300/123* (2013.01); *B01L 2400/0481* (2013.01); *B01L 2400/082* (2013.01); *B41J 2002/14467* (2013.01); *B41J 2202/12* (2013.01)

(58) Field of Classification Search

CPC ..... B01L 2400/082; B01L 2300/123; B01L 2300/088; B01L 2300/0816; B41J 2/18; B41J 2/1404; B41J 2/1753; B41J 2/14201; B41J 2202/12; B41J 2202/14467; B41J 2202/14466; F04B 43/02; F04B 43/028; F04B 43/04; F04B 43/043; F04B 43/046; F04B 45/04; F04B 45/045; F04B 45/047; F04B 19/24; F04B 17/003; F04B 19/006; F04B 49/06; F04B 2207/043

USPC ..... 417/393, 394, 395, 413.1, 413.2, 413.3; 137/833, 828, 829

See application file for complete search history.

(56) References Cited

U.S. PATENT DOCUMENTS 4,318,114 A 3/1982 Huliba
5,412,411 A 5/1995 Anderson
5,807,749 A 9/1998 Hoernemann
5,818,485 A 10/1998 Rezanka
5,820,260 A 10/1998 Vander Heyden et al.
6,010,316 A * 1/2000 Haller ..... B01L 3/50273 366/DIG. 4
6,017,117 A 1/2000 McClelland et al.
6,055,002 A 4/2000 Wen et al.
6,079,873 A 6/2000 Cavicchi et al.
6,106,091 A 8/2000 Osawa et al.
6,152,559 A 11/2000 Kojima
6,193,413 B1 2/2001 Lieberman
6,227,660 B1 5/2001 McClelland et al.
6,227,824 B1 5/2001 Stehr
6,244,694 B1 * 6/2001 Weber ..... B41J 2/055 347/65
6,283,718 B1 9/2001 Prosperetti et al.
6,351,879 B1 3/2002 Furlani et al.
6,360,775 B1 3/2002 Barth et al.
6,431,694 B1 8/2002 Ross
6,450,773 B1 9/2002 Upton
6,467,887 B2 10/2002 Lopez et al.
6,481,984 B1 11/2002 Shinohara
6,568,799 B1 5/2003 Yang et al.
6,631,983 B2 10/2003 Romano, Jr. et al.
6,655,924 B2 12/2003 Ma
6,730,206 B2 5/2004 Ricco et al.
6,752,493 B2 6/2004 Dowell et al.
6,910,797 B2 6/2005 Falcon
6,953,236 B2 10/2005 Silverbrook
7,025,323 B2 4/2006 Krulevitch et al.
7,040,745 B2 5/2006 Kent
7,049,558 B2 5/2006 Baer et al.
7,094,040 B2 * 8/2006 Higashino ..... F04B 43/043 417/413.2
7,097,287 B2 8/2006 Nakao et al.
7,118,189 B2 10/2006 Kuester et al.
7,182,442 B2 2/2007 Sheinman
7,204,585 B2 4/2007 Bruinsma et al.
7,217,395 B2 5/2007 Sander
7,291,512 B2 11/2007 Unger
7,427,274 B2 9/2008 Harris et al.
7,470,004 B2 12/2008 Eguchi et al.
7,543,923 B2 6/2009 McNestry
7,647,860 B2 1/2010 Creswell
7,727,478 B2 6/2010 Higashino et al.
7,762,719 B2 7/2010 Fon et al.
7,763,453 B2 7/2010 Clemmens et al.
7,784,495 B2 8/2010 Prakash et al.
7,832,429 B2 11/2010 Young et al.
7,871,160 B2 1/2011 Kang et al.
8,286,656 B2 10/2012 Rastegar et al.
8,329,118 B2 12/2012 Padmanabhan et al.
8,439,481 B2 5/2013 Xie et al.
8,540,355 B2 9/2013 Govyadinov et al.
8,651,646 B2 2/2014 Govyadinov et al.
8,757,783 B2 6/2014 Govyadinov et al.
8,939,531 B2 1/2015 Govyadinov et al.
9,090,084 B2 7/2015 Govyadinov
2001/0030130 A1 10/2001 Ricco et al.
2002/0009374 A1 1/2002 Higashino
2002/0098122 A1 7/2002 Singh et al.
2002/0156383 A1 10/2002 Altman et al.
2002/0197167 A1 12/2002 Kornelsen
2003/0086790 A1 5/2003 Ma
2003/0215342 A1 11/2003 Higashino
2004/0024002 A1 2/2004 Burnett et al.
2004/0063217 A1 4/2004 Webster
2004/0180377 A1 9/2004 Manger
2004/0200724 A1 10/2004 Fujii et al.
2004/0202548 A1 10/2004 Dai et al.
2005/0052513 A1 3/2005 Inoue
2005/0069425 A1 3/2005 Gray et al.
2005/0092662 A1 5/2005 Gilbert
2005/0129529 A1 6/2005 Cho
2005/0196304 A1 9/2005 Richter et al.
2005/0220630 A1 10/2005 Bohm
2005/0249607 A1 11/2005 Klee
2005/0282054 A1 12/2005 Ishida et al.
2006/0046300 A1 3/2006 Padmanabhan et al.
2006/0051218 A1 3/2006 Harttig
2006/0123892 A1 6/2006 Brekelmans et al.
2007/0026421 A1 2/2007 Sundberg et al.
2007/0286254 A1 12/2007 Fon
2007/0291082 A1 12/2007 Baumer
2008/0007604 A1 1/2008 Kang et al.
2008/0047836 A1 2/2008 Strand et al.
2008/0050283 A1 2/2008 Chou et al.
2008/0079791 A1 4/2008 Kang et al.
2008/0087584 A1 4/2008 Johnson et al.
2008/0118790 A1 5/2008 Kim
2008/0055378 A1 6/2008 Drury et al.
2008/0138247 A1 6/2008 Inganas et al.
2008/0143793 A1 6/2008 Okuda
2008/0260582 A1 10/2008 Gauer et al.
2009/0007969 A1 1/2009 Gundel
2009/0014360 A1 1/2009 Toner et al.
2009/0027429 A1 1/2009 Jung
2009/0027458 A1 1/2009 Leighton et al.
2009/0038938 A1 2/2009 Mezic et al.
2009/0040257 A1 2/2009 Bergstedt et al.
2009/0052494 A1 2/2009 Wijffels
2009/0079789 A1 3/2009 Silverbrook
2009/0128922 A1 5/2009 Justis et al.
2009/0147822 A1 6/2009 Tokhtuev et al.
2009/0148933 A1 6/2009 Battrell et al.
2009/0246086 A1 10/2009 Barbier
2009/0270834 A1 10/2009 Nisato et al.

(56) References Cited

U.S. PATENT DOCUMENTS

| | | | | |
|---|---|---|---|---|
| 2009/0297372 | A1 | 12/2009 | Amirouche | |
| 2010/0013887 | A1 | 1/2010 | Suh | |
| 2010/0024572 | A1 | 2/2010 | Roukes et al. | |
| 2010/0101764 | A1 | 4/2010 | Yang | |
| 2010/0173393 | A1 | 7/2010 | Handique et al. | |
| 2010/0212762 | A1 | 8/2010 | Den Toonder et al. | |
| 2010/0328403 | A1 | 12/2010 | Xie | |
| 2011/0240752 | A1 | 10/2011 | Meacham | |
| 2011/0286493 | A1* | 11/2011 | Torniainen | B41J 2/1404 374/33 |
| 2012/0015376 | A1 | 1/2012 | Bornhop | |
| 2012/0098907 | A1 | 4/2012 | Xie et al. | |
| 2012/0244604 | A1* | 9/2012 | Kornilovich | B01L 3/50273 435/286.1 |
| 2013/0061936 | A1 | 3/2013 | Govyadinov et al. | |
| 2013/0083136 | A1 | 4/2013 | Govyadinov et al. | |
| 2015/0091989 | A1* | 4/2015 | Govyadinov | B41J 2/04541 347/89 |
| 2015/0273853 | A1 | 10/2015 | Govyadinov et al. | |

FOREIGN PATENT DOCUMENTS

| | | | |
|---|---|---|---|
| CN | 1673528 | | 9/2005 |
| CN | 1678460 | | 10/2005 |
| CN | 101100137 | | 1/2008 |
| CN | 101267885 | | 9/2008 |
| CN | 101287606 | | 10/2008 |
| CN | 101306792 | | 11/2008 |
| CN | 101391530 | | 3/2009 |
| CN | 102971150 | A1 | 3/2013 |
| CN | 102985261 | A | 3/2013 |
| CN | 102985831 | | 3/2013 |
| CN | 103003577 | | 3/2013 |
| CN | 103025530 | | 4/2013 |
| CN | 103153627 | A | 6/2013 |
| EP | 0568902 | | 4/1993 |
| EP | 1052099 | | 11/2000 |
| EP | 1518683 | | 3/2005 |
| EP | 2018969 | | 1/2009 |
| JP | H0526170 | | 2/1993 |
| JP | H10175307 | | 6/1998 |
| JP | 2001-205810 | | 7/2001 |
| JP | 2001-322099 | | 11/2001 |
| JP | 2003-527616 | | 9/2003 |
| JP | 2003-528276 | | 9/2003 |
| JP | 2003-286940 | | 10/2003 |
| JP | 2003-534538 | | 11/2003 |
| JP | 2004-513342 | | 4/2004 |
| JP | 2004-169706 | | 6/2004 |
| JP | 2004-190614 | | 7/2004 |
| JP | 2004-249741 | | 9/2004 |
| JP | 2005-125668 | | 5/2005 |
| JP | 2006-510854 | | 3/2006 |
| JP | 2006-512545 | | 4/2006 |
| JP | 2006-156894 | | 6/2006 |
| JP | 2006-272614 | | 10/2006 |
| JP | 2007-224844 | | 9/2007 |
| JP | 2008-162270 | | 7/2008 |
| JP | 2009-117344 | | 5/2009 |
| JP | 2009-190370 | | 8/2009 |
| JP | 2013529566 | | 7/2013 |
| JP | 5631501 | | 11/2014 |
| JP | 5746342 | | 7/2015 |
| JP | 5756852 | | 7/2015 |
| JP | 2015211965 | | 11/2015 |
| KR | 20030059797 | | 7/2003 |
| KR | 20080004095 | | 1/2008 |
| KR | 20090082563 | | 7/2009 |
| KR | 20090108371 | | 10/2009 |
| KR | 20130050344 | | 5/2013 |
| KR | 20130113957 | | 10/2013 |
| KR | 20130118222 | | 10/2013 |
| KR | 20130137638 | | 12/2013 |
| TW | I458645 | | 11/2014 |
| WO | WO-0171226 | | 9/2001 |
| WO | WO-2008091294 | | 7/2008 |
| WO | WO-2011146069 | | 11/2011 |
| WO | WO-2011146145 | | 11/2011 |
| WO | WO-2011146156 | | 11/2011 |
| WO | WO-2012008978 | | 1/2012 |
| WO | WO-2012015397 | | 2/2012 |
| WO | WO2012057758 | | 5/2012 |

OTHER PUBLICATIONS

Hany, et al, "Thermal Analysis of Chemical Reaction With a Continuous Microfluidic Calorimeter"; Chemical Engineering Journal 160 (2010); Jul. 10, 2009; pp. 814-822.

Leslie, et. al. "requency-specific Flow Control in Microfluidic Circuits with Passive Elastomeric Features"; Nature Physics; Feb. 1, 2009; pp. 231-235.

Fadl, et al; "The effect of the Microfluidic Diodicity on the Efficiency of Valve-Less Rectification Micropumps Using Lattice Boltzmann Method"; Microsyst Technol; Jul. 2009.

Koltay, et al; "Non-Contact Liquid Handling: Basics and Technologies"; http://www.labautopedia.com/mw/index.phb/Non-Contact Liquid Handling: Basics and Technologies.

Yeo, et al., "Fast Inertial Microfluidic Actuation and Manipulation Using Surface Acoustic Waves"; FEDSM-ICNMM2010 Meeting; Aug. 1-5, 2010, pp. 1-8.

Inkjet Photo Printers, Ink, Paper, and Laser Toner Tool; InkJet Printers Paper Reviews; inkjethelper.com; retreived Oct. 26, 2010.

Ramirez-Garcia, Sonia, et.al. "Towards the Development of a Fully Integrated Polymeric Microfluidic Platform for Environmental Analysis"; Elesvier B.V.; Apr. 12, 2008, pp. 463-467.

Zhang, et al. "Micropumps, Microvalves, and Micromixers Within Pcr Microfluidic Chips: Advances and Trends"; http://laser.scnu.edu.cn/xingdaPDF/Zhang%20Chunsun%20Biotech%20Adv%202007.pdf > Publication Date: May 23, 2007; On pp. 483-514; Chunsun Zhang et al.

* cited by examiner

MICROFLUIDIC SYSTEMS AND NETWORKS

CROSS REFERENCE TO RELATED APPLICATIONS

The present application is a continuation application that claims priority from co-pending U.S. patent application Ser. No. 13/698,064 filed on Nov. 15, 2012 by Kornilovich et al. and entitled MICROFLUIDIC SYSTEMS AND NETWORKS, the full disclosure of which is hereby incorporated by reference.

BACKGROUND

Microfluidics is an increasingly important technology that applies across a variety of disciplines including engineering, physics, chemistry, microtechnology and biotechnology. Microfluidics involves the study of small volumes of fluid and how to manipulate, control and use such small volumes of fluid in various microfluidic systems and devices such as microfluidic chips. For example, microfluidic biochips (referred to as "lab-on-chip") are used in the field of molecular biology to integrate assay operations for purposes such as analyzing enzymes and DNA, detecting biochemical toxins and pathogens, diagnosing diseases, etc.

The beneficial use of many microfluidic systems depends in part on the ability to properly introduce fluids into microfluidic devices and to control the flow of fluids through the devices. In general, an inability to manage fluid introduction and flow in microfluidic devices on a micrometer scale limits their application outside of a laboratory setting where their usefulness in environmental and medical analysis is especially valuable. Prior methods of introducing and controlling fluid in microfluidic devices have included the use of external equipment and various types of pumps that are not micrometer in scale. These prior solutions have disadvantages related, for example, to their large size, their lack of versatility, and their complexity, all of which can limit the functionality of the microfluidic systems implementing such microfluidic devices.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
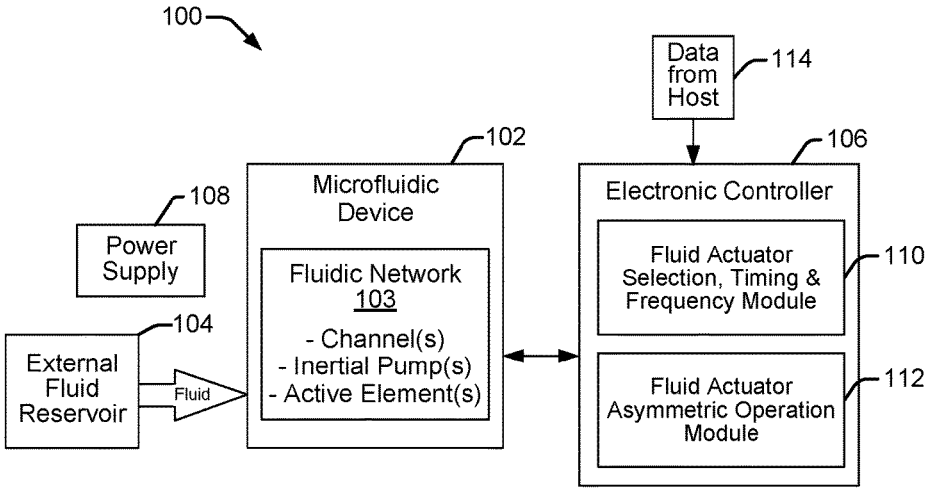
FIG. 1 shows a microfluidic system suitable for incorporating microfluidic devices, networks and inertial pumps, according to an embodiment.

As noted above, previous methods of managing fluid in microfluidic devices include the use of external equipment and pump mechanisms that are not micrometer in scale. These solutions have disadvantages that can limit the range of applications for microfluidic systems. For example, external syringes and pneumatic pumps are sometimes used to inject fluids and generate fluid flow within microfluidic devices. However, the external syringes and pneumatic pumps are bulky, difficult to handle and program, and have unreliable connections. These types of pumps are also limited in versatility by the number of external fluidic connections the microfluidic device/chip can accommodate.

Another type of pump is a capillary pump that works on the principle of a fluid filling a set of thin capillaries. As such, the pump provides only a single-pass capability. Since the pump is completely passive, the flow of fluid is "hard-wired" into the design and cannot be reprogrammed. Electrophoretic pumps can also be used, but require specialized coating, complex three-dimensional geometries and high operating voltages. All these properties limit the applicability of this type of pump. Additional pump types include peristaltic and rotary pumps. However, these pumps have moving parts and are difficult to miniaturize.

Embodiments of the present disclosure improve on prior solutions for fluid management in microfluidic systems and devices, generally through improved microfluidic devices that enable complex and versatile microfluidic networks having integrated inertial pumps with fluid actuators. The disclosed microfluidic networks may have one-dimensional, two-dimensional, and/or three-dimensional topologies, and can therefore be of considerable complexity. Each fluidic channel edge within a network can contain one, more than one, or no fluid actuator. Fluid actuators integrated within microfluidic network channels at asymmetric locations can generate both unidirectional and bidirectional fluid flow through the channels. Selective activation of multiple fluid actuators located asymmetrically toward the ends of multiple microfluidic channels in a network enables the generation of arbitrary and/or directionally-controlled fluid flow patterns within the network. In addition, temporal control over the mechanical operation or motion of a fluid actuator enables directional control of fluid flow through a fluidic network channel. Thus, in some embodiments precise control over the forward and reverse strokes (i.e., compressive and tensile fluid displacements) of a single fluid actuator can provide bidirectional fluid flow within a network channel and generate arbitrary and/or directionally-controlled fluid flow patterns within the network.

The fluid actuators can be driven by a variety of actuator mechanisms such as thermal bubble resistor actuators, piezo membrane actuators, electrostatic (MEMS) membrane actuators, mechanical/impact driven membrane actuators, voice coil actuators, magneto-strictive drive actuators, and so on. The fluid actuators can be integrated into microfluidic systems using conventional microfabrication processes. This enables complex microfluidic devices having arbitrary pressure and flow distributions. The microfluidic devices may also include various integrated active elements such as resistive heaters, Peltier coolers, physical, chemical and biological sensors, light sources, and combinations thereof. The microfluidic devices may or may not be connected to external fluid reservoirs. Advantages of the disclosed microfluidic devices and networks generally include a reduced amount of equipment needed to operate microfluidic systems, which increases mobility and widens the range of potential applications.

In one example embodiment, a microfluidic system includes a fluidic channel coupled at both ends to a reservoir. A fluid actuator is located asymmetrically within the channel creating a long and short side of the channel that have non-equal inertial properties. The fluid actuator is to generate a wave that propagates toward both ends of the channel and produces a unidirectional net fluid flow through the channel. A controller can selectively activate the fluid actuator to control the unidirectional net fluid flow through the channel. In one implementation, the fluid actuator is a first fluid actuator located toward a first end of the channel, and a second fluid actuator is located asymmetrically within the channel toward a second end of the channel. The controller can activate the first fluid actuator to cause net fluid flow through the channel in a first direction from the first end to the second end, and can activate the second fluid actuator to cause net fluid flow through the channel in a second direction from the second end to the first end.

In another example embodiment, a microfluidic system includes a network of microfluidic channels having first and second ends. The channel ends are coupled variously to one another at end-channel intersections. At least one channel is a pump channel having a short side and a long side distinguished by a fluid actuator located asymmetrically between opposite ends of the pump channel. The fluid actuator is to generate a wave propagating toward the opposite ends of the pump channel that produces a unidirectional net fluid flow through the pump channel. In one implementation, a second fluid actuator integrated within the channel is located asymmetrically toward a second end of the pump channel, and a controller can selectively activate the first and second fluid actuators to generate bidirectional fluid flow through the network. In another implementation, additional fluid actuators are located asymmetrically toward first and second ends of multiple microfluidic channels and a controller can selectively activate the fluid actuators to induce directionally-controlled fluid flow patterns throughout the network.

In another embodiment, a microfluidic network includes microfluidic channels in a first plane to facilitate two-dimensional fluid flow through the network within the first plane. A microfluidic channel in the first plane extends into a second plane to cross over and avoid intersection with another microfluidic channel in the first plane, which facilitates three-dimensional fluid flow through the network within the first and second planes. An active element is integrated within at least one microfluidic channel. Fluid actuators are integrated asymmetrically within at least one microfluidic channel, and a controller can selectively activate the fluid actuators to induce directionally-controlled fluid flow patterns within the network.

In another example embodiment, a method of generating net fluid flow in a microfluidic network includes generating compressive and tensile fluid displacements that are temporally asymmetric in duration. The displacements are generated using a fluid actuator that is integrated asymmetrically within a microfluidic channel.

In another example embodiment, a microfluidic system includes a microfluidic network. A fluid actuator is integrated at an asymmetric location within a channel of the network to generate compressive and tensile fluid displacements of different durations within the channel. A controller regulates fluid flow direction through the channel by controlling the compressive and tensile fluid displacement durations of the fluid actuator.

In another example embodiment, a method of controlling fluid flow in a microfluidic network includes generating asymmetric fluid displacements in a microfluidic channel with a fluid actuator located asymmetrically within the channel.

Illustrative Embodiments

FIG. 1 illustrates a microfluidic system 100 suitable for incorporating microfluidic devices, networks and inertial pumps as disclosed herein, according to an embodiment of the disclosure. The microfluidic system 100 can be, for example, an assay system, a microelectronics cooling system, a nucleic acid amplification system such as a polymerase chain reaction (PCR) system, or any system that involves the use, manipulation and/or control of small volumes of fluid. Microfluidic system 100 typically implements a microfluidic device 102 such as a microfluidic chip (e.g., a "lab-on-a-chip") to enable a wide range of microfluidic applications. A microfluidic device 102 generally includes one or more fluidic networks 103 having channels with inertial pumps for circulating fluid throughout the network. In general, the structures and components of a microfluidic device 102 can be fabricated using conventional integrated circuit microfabrication techniques such as electroforming, laser ablation, anisotropic etching, sputtering, dry etching, photolithography, casting, molding, stamping, machining, spin coating and laminating. A microfluidic system 100 may also include an external fluid reservoir 104 to supply and/or circulate fluid to microfluidic device 102. Microfluidic system 100 also includes an electronic controller 106 and a power supply 108 to provide power to microfluidic device 102, the electronic controller 106, and other electrical components that may be part of system 100.

Electronic controller 106 typically includes a processor, firmware, software, one or more memory components including volatile and non-volatile memory components, and other electronics for communicating with and controlling microfluidic device 102 and fluid reservoir 104. Accordingly, electronic controller 106 is programmable and typically includes one or more software modules stored in memory and executable to control microfluidic device 102. Such modules may include, for example, a fluid actuator selection, timing and frequency module 110, and a fluid actuator asymmetric operation module 112, as shown in FIG. 1.

Electronic controller 106 may also receive data 114 from a host system, such as a computer, and temporarily store the data 114 in a memory. Typically, data 114 is sent to microfluidic system 100 along an electronic, infrared, optical, or other information transfer path. Data 114 represents, for example, executable instructions and/or parameters for use alone or in conjunction with other executable instructions in software/firmware modules stored on electronic controller 106 to control fluid flow within microfluidic device 102. Various software and data 114 executable on programmable controller 106 enable selective activation of fluid actuators integrated within network channels of a microfluidic device 102, as well as precise control over the timing, frequency and duration of compressive and tensile displacements of such activation. Readily modifiable (i.e., programmable) control over the fluid actuators allows for an abundance of fluid flow patterns available on-the-fly for a given microfluidic device 102.

Figure 2:
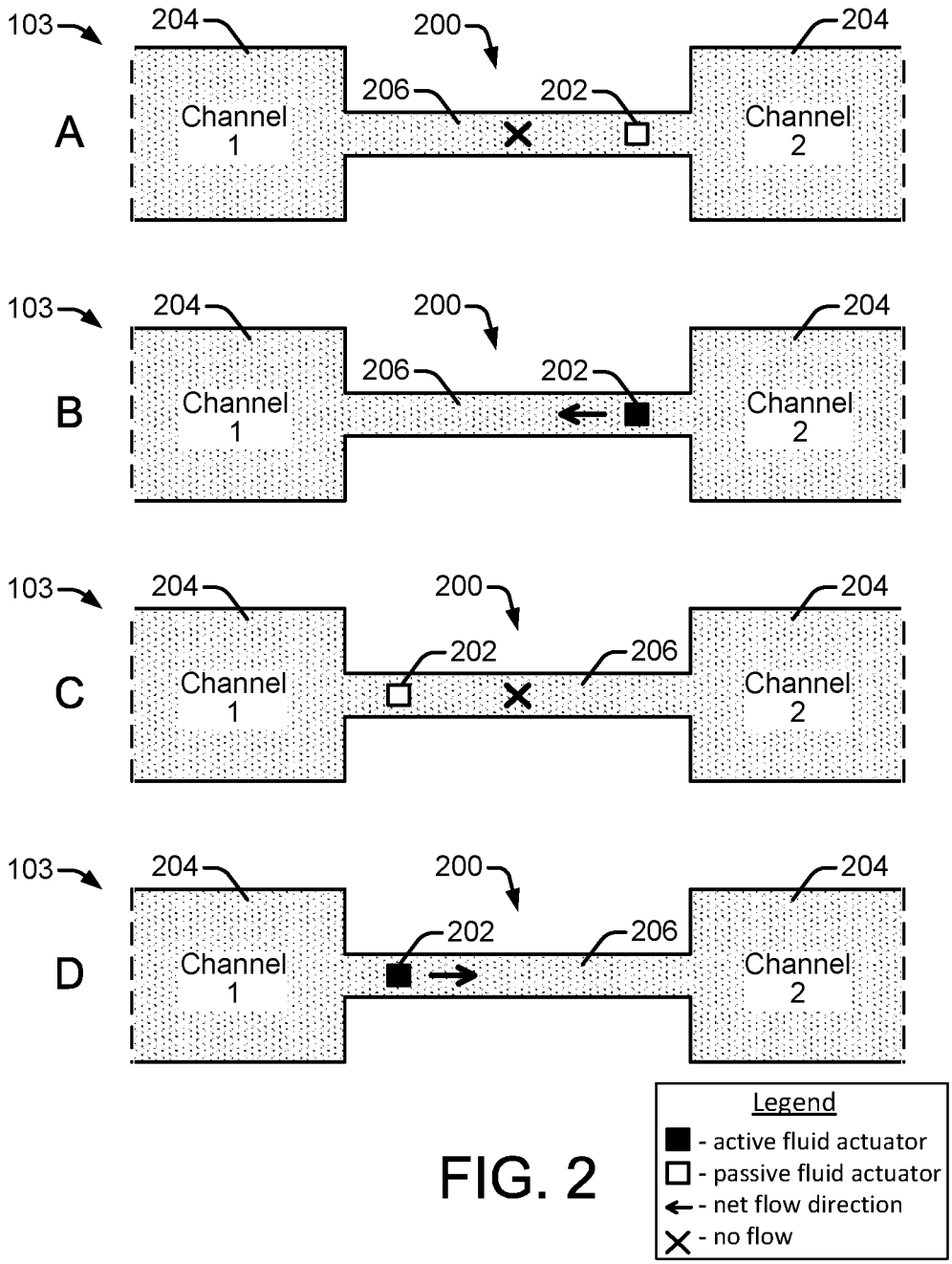
FIG. 2 shows examples of closed, unidirectional, one-dimensional fluidic networks with integrated inertial pumps, according to some embodiments.

FIG. 2 shows examples of closed, unidirectional, one-dimensional (i.e., linear) fluidic networks 103 (A, B, C, D) having integrated inertial pumps 200 suitable for implementing within a microfluidic device 102, according to embodiments of the disclosure. As used in this document: A "closed" network means a network that has no connections with an external fluid reservoir; A "unidirectional" network means a network that generates fluid flow in only one direction; and, A one-dimensional network means a linear network. An inertial pump 200 generally includes a pump channel 206 with an integrated fluid actuator 202 disposed asymmetrically toward one end of the pump channel 206. Note that in some embodiments as discussed below, a network channel 204 itself serves as a pump channel 206. The example inertial pumps 200 of FIG. 2 each have a fluid pump actuator 202 to move fluid through the pump channel 206 between network channels 204 (1 and 2). In this example, each network channel 204 serves as a fluid reservoir at each end of pump channel 206. Although the networks 103 (A, B, C, D) are one-dimensional (i.e., linear) with fluid to flow from one end to the other end, the dashed lines shown at the ends of the network channels 204 (1 and 2) are intended to indicate that in some embodiments the network channels 204 may extend farther as part of a larger network 103 that has additional dimensions (i.e., two and three dimensions) where the network channels 204 intersect with other network channels as part of such a larger network 103. Examples of such larger networks are discussed below.

The four inertial pumps 200 shown in networks A, B, C and D, of FIG. 2 each contain a single integrated fluid pump actuator 202 located asymmetrically within the pump channels 206 toward one end of the pump channel 206. The fluid actuators 202 in the pumps 200 of networks A and C are passive, or not activated, as indicated by the Legend provided in FIG. 2. Therefore, there is no net fluid flow through the pump channels 206 between network channels 1 and 2 (204). However, the fluid actuators 202 in the pumps 200 of networks B and D are active, which generates net fluid flow through the pump channels 206 between network channels 1 and 2 (204).

A fluidic diodicity (i.e., unidirectional flow of fluid) is achieved in active inertial pumps 200 of networks B and D through the asymmetric location of the fluid actuators 202 within the pump channels 206. When the width of the inertial pump channel 206 is smaller than the width of the network channels 204 it is connecting (e.g., network channels 1 and 2), the driving power of the inertial pump 200 is primarily determined by the properties of the pump channel 206 (i.e., the width of the pump channel and the asymmetry of the fluid actuator 202 within the pump channel). The exact location of a fluid actuator 202 within the pump channel 206 may vary somewhat, but in any case will be asymmetric with respect to the length of the pump channel 206. Thus, the fluid actuator 202 will be located to one side of the center point of the pump channel 206. With respect to a given fluid actuator 202, its asymmetric placement creates a short side of the pump channel 206 and a long side of the pump channel 206. Thus, the asymmetric location of the active fluid actuator 202 in inertial pump 200 of network B nearer to the wider network channel 2 (204) is the basis for the fluidic diodicity within the pump channel 206 which causes the net fluid flow from network channel 2 to network channel 1 (i.e., from right to left). Likewise, the location of the active fluid actuator 202 in pump 200 of network D at the short side of the pump channel 206 causes the net fluid flow from network channel 1 to network channel 2 (i.e., from left to right). The asymmetric location of the fluid actuator 202 within the pump channel 206 creates an inertial mechanism that drives fluidic diodicity (net fluid flow) within the pump channel 206. The fluid actuator 202 generates a wave propagating within the pump channel 206 that pushes fluid in two opposite directions along the pump channel 206. When the fluid actuator 202 is located asymmetrically within the pump channel 206, there is a net fluid flow through the pump channel 206. The more massive part of the fluid (contained, typically, in the longer side of the pump channel 206) has larger mechanical inertia at the end of a forward fluid actuator pump stroke. Therefore, this body of fluid reverses direction more slowly than the liquid in the shorter side of the channel. The fluid in the shorter side of the channel has more time to pick up the mechanical momentum during the reverse fluid actuator pump stroke. Thus, at the end of the reverse stroke the fluid in the shorter side of the channel has larger mechanical momentum than the fluid in the longer side of the channel. As a result, the net flow is typically in the direction from the shorter side to the longer side of the pump channel 206. Since the net flow is a consequence of non-equal inertial properties of two fluidic elements (i.e., the short and long sides of the channel), this type of micropump is called an inertial pump.

Figure 3:
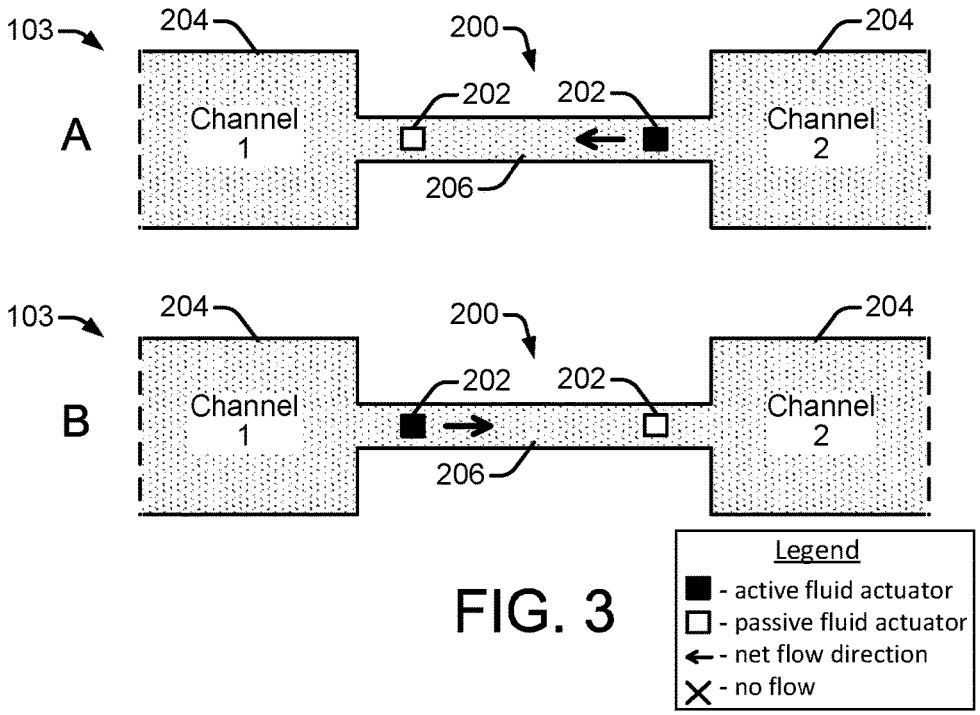
FIG. 3 shows examples of closed, bidirectional, one-dimensional fluidic networks with integrated inertial pumps, according to some embodiments.

FIG. 3 shows examples of closed, bidirectional, one-dimensional (i.e., linear) fluidic networks 103 (A, B) having integrated inertial pumps 200 suitable for implementing within a microfluidic device 102 such as discussed above with reference to FIG. 2, according to embodiments of the disclosure. Instead of one fluid pump actuator 202, the example inertial pumps 200 of FIG. 3 have two fluid pump actuators 202 to move fluid through and between network channels 204. The two fluid actuators 202 are located asymmetrically toward opposite sides of each pump channel 206. Having a fluid actuator 202 at each side of the pump channel 206 enables the generation of net fluid flow through the channel 206 in either direction depending on which fluid actuator 202 is active. Thus, in inertial pump 200 of network A of FIG. 3, the active fluid actuator 202 is located asymmetrically toward the right side of the pump channel 206 near network channel 2, and the net fluid flow generated is from the right side of the pump channel 206 (the short side) to the left side (the long side), which moves fluid from network channel 2 toward network channel 1. Similarly, in inertial pump 200 of network B, the active fluid actuator 202 is located asymmetrically toward the left side of the pump channel 206 near network channel 1, and the net fluid flow generated is from the left side of the pump channel 206 (again, the short side) to the right side (the long side), which moves fluid from network channel 1 toward network channel 2.

As noted above, controller 106 is programmable to control a microfluidic device 102 in a variety of ways. As an example, with respect to the inertial pumps 200 of FIG. 2 which each have a single integrated fluid pump actuator 202, the module 110 (i.e., the fluid actuator selection, timing and frequency module 110) in controller 106 enables the selective activation of any number of actuators 202 in any number of pump channels 206 throughout a network 103. Thus, although the networks A, B, C, and D, are one-dimensional, having inertial pumps 200 with only one fluid actuator 202, in different embodiments they may be part of larger networks where selective activation of other actuators 202 in other interconnecting network channels 204 can enable control over the direction of fluid flow throughout a larger network 103. Module 110 also enables control over the timing and frequency of activation of the fluid actuators 202 to manage when net fluid flow is generated and the rate of fluid flow. With respect to the inertial pumps 200 of FIG. 3, which have two fluid actuators 202 located asymmetrically toward opposite sides of each pump channel 206, the module 110 on controller 106 enables selective activation of the two actuators within a single pump channel 206 in addition to selective activation of any number of actuators in any number of other pump channels throughout a larger network 103. The ability to selectively activate fluid actuators in this manner enables control over the direction of fluid flow within individual network channels 204, as well as throughout an entire expanded network 103.

Figure 4:
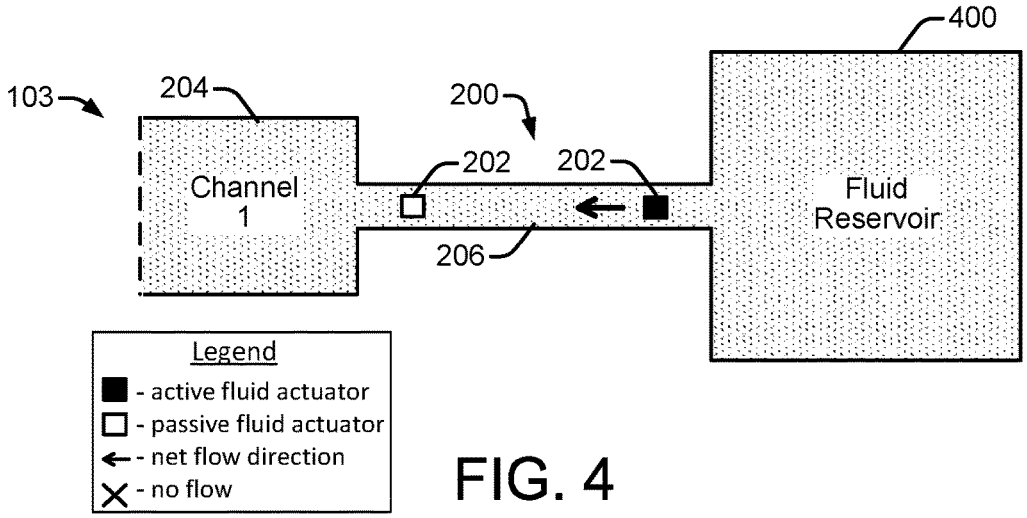
FIG. 4 shows an example of an open, bidirectional, one-dimensional fluidic network with an integrated inertial pump, according to an embodiment.

FIG. 4 shows an example of an open, bidirectional, one-dimensional fluidic network 103 having an integrated inertial pump 200 suitable for implementing within a microfluidic device 102, according to an embodiment of the disclosure. As used in this document, an "open" network is a network that connects to at least one external fluid reservoir such as reservoir 400. When connecting with a fluid reservoir 400, in the same manner as connecting with network channels 204, if the width of the inertial pump 200 is smaller than the width of the fluid reservoir 400 it is connecting to, the driving power of the inertial pump 200 is primarily determined by the properties of the pump channel 206 (i.e., the width of the pump channel and the asymmetry of the fluid actuator 202 within the pump channel). Thus, in this example, while one end of the pump channel 206 connects to an external fluid reservoir 400 and the other end of the pump channel 206 connects to a network channel 204 (Channel 1), both the reservoir 400 and the network channel 204 serve as fluid reservoirs with respect to the driving power of the inertial pump 200. In other implementations of such an "open" network 103, both ends of the pump channel 206 can readily be connected to external fluid reservoirs 400. The asymmetric location of the fluid actuator 202 in pump 200 of network 103 at the short side of the pump channel 206 near the wider fluid reservoir 400 is the basis for fluidic diodicity within the pump channel 206 which causes a net fluid flow from the fluid reservoir 400 to network channel 1 (i.e., from right to left). Note that one reservoir 400 can be connected to a network 103 by more than one pump channel 206, or to one or more network channels 204 with or without any inertial pumps. In general, reservoirs may facilitate a variety of fluidic applications by providing storage and access to various fluids such as biological samples to be analyzed, waste collectors, containers of DNA building blocks and so on.

Figure 5:
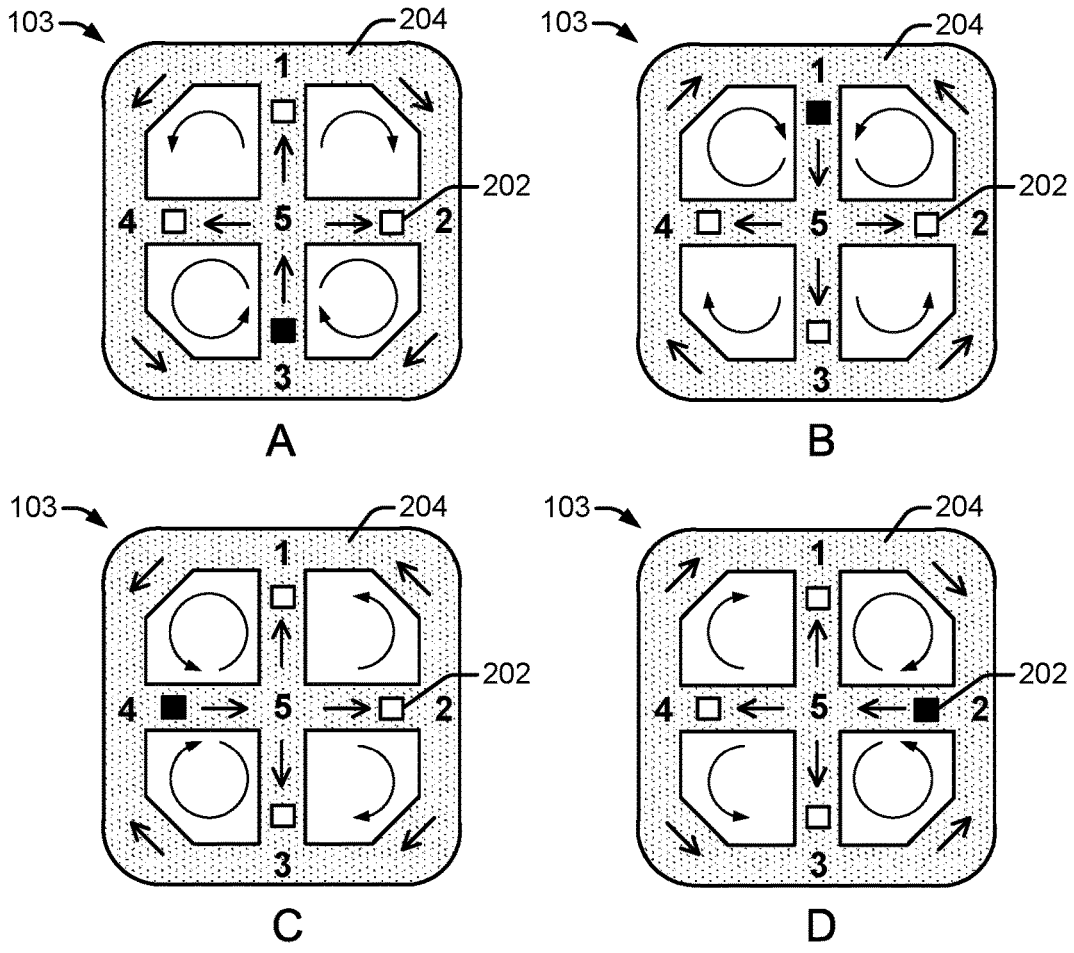
FIG. 5 shows an example of a closed, two-dimensional fluidic network illustrating fluid flow patterns generated by different pump activation regimes through selective activation of single fluid pump actuators, according to an embodiment.
Figure 5:
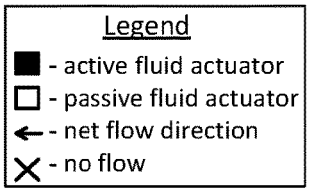
Figure 6:
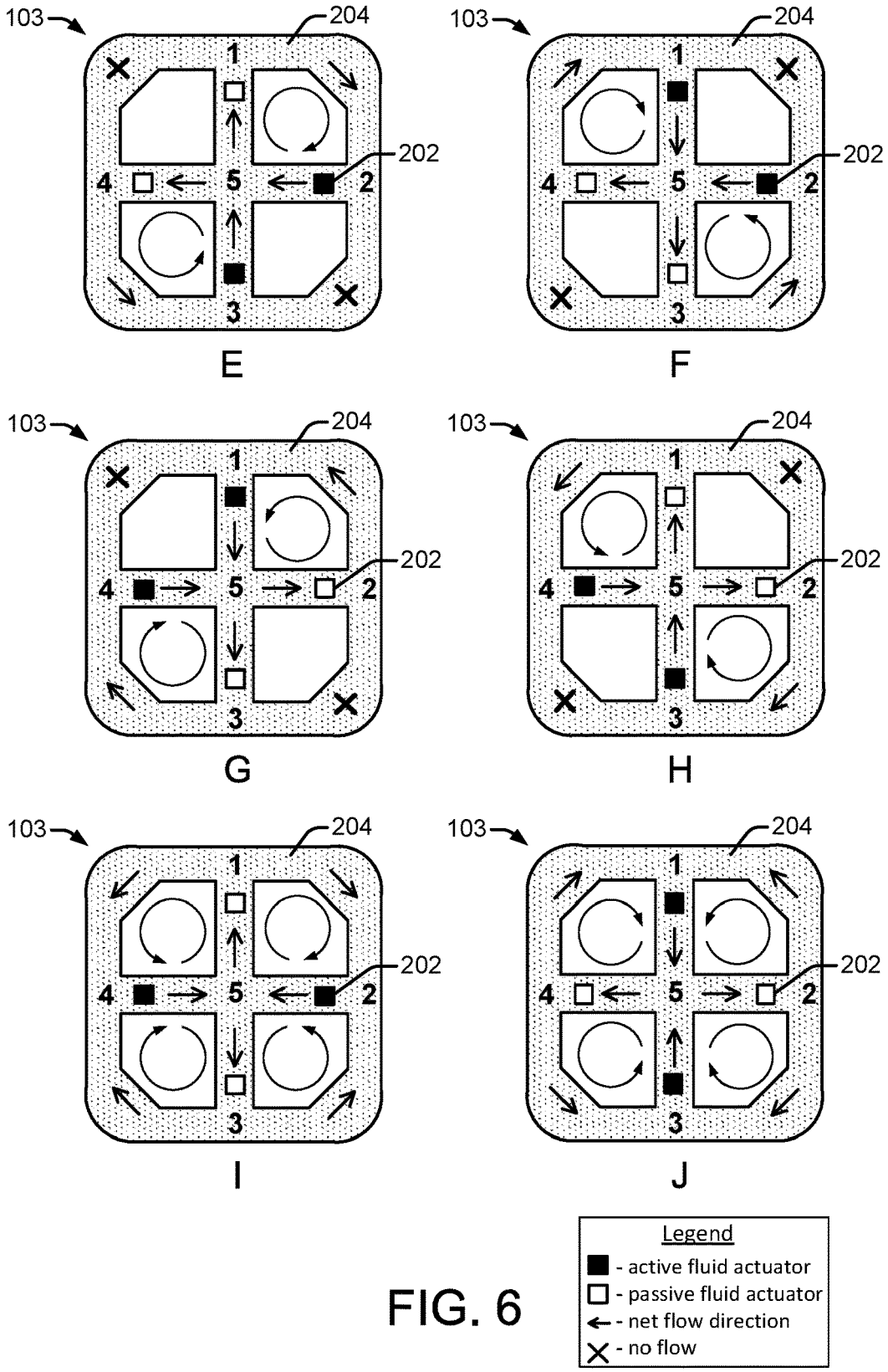
FIG. 6 shows an example of a closed, two-dimensional fluidic network illustrating fluid flow patterns generated by different pump activation regimes through selective activation of two fluid pump actuators, according to an embodiment.
Figure 7:
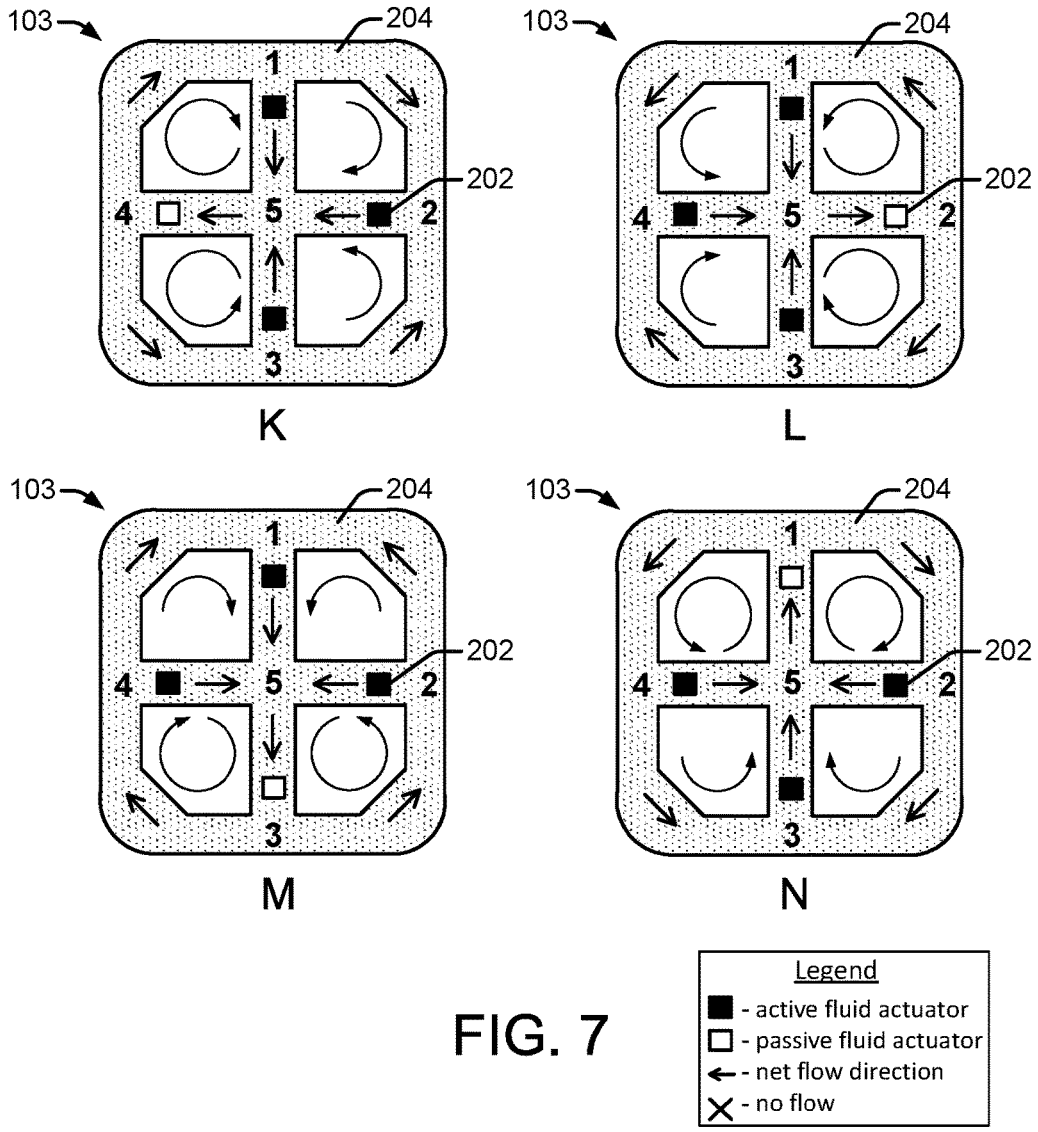
FIG. 7 shows an example of a closed, two-dimensional fluidic network illustrating fluid flow patterns generated by different pump activation regimes through selective activation of three fluid pump actuators, according to an embodiment.

Networks 103 within a microfluidic device 102 may have one-dimensional, two-dimensional, or three-dimensional topologies, as noted above. For example, the networks 103 in FIGS. 2 and 3 discussed above are shown as linear, or one-dimensional networks 103. However, the network channels 204 within these networks are also discussed in terms of potentially being connected to other network channels as part of larger networks 103. FIGS. 5-7 show examples of such larger networks 103, demonstrating two-dimensional network topologies.

FIG. 5 shows an example of a closed, two-dimensional fluidic network 103 illustrating fluid flow patterns (A, B, C, D) generated by different pump activation regimes through selective activation of singular fluid pump actuators 202 within the network 103, according to an embodiment of the disclosure. The two-dimensional network 103 has four fluid pump actuators 202 and eight network channels (or edges) separated by five vertices or channel intersections (referenced as 1, 2, 3, 4, 5). As shown by such figures, network 103 comprises four loops interconnected at a junction formed by vertex 5. Network 103 comprises a first loop formed by those channels 204 extending between and interconnecting vertices 1, 4 and 5, a second loop formed by those channels 204 extending between and interconnecting vertices 1, 2 and 5, a third loop formed by those channels 204 extending between interconnecting vertices 2, 3 and 5 and a third loop formed by those channels 204 extending between and interconnecting vertices 3, 4 and 5. In the illustrated embodiment, inertial pumps include fluid pump actuators 202 integrated into network channels 204. Therefore, separate pump channels as discussed above in previous networks are not shown. The network channels 204 themselves serve as pump channels for the fluid pump actuators 202. The narrower widths of the network channels 204 connected at the wider channel intersections (vertices 1, 2, 3, 4, 5) enables the driving power of the inertial pump, which is based on the asymmetric placement of the fluid actuators 202 within the narrower widths of the network channels 204.

Referring to network 103 of FIG. 5 exhibiting fluid flow pattern A, the active fluid actuator 202 (see the Legend in FIG. 5 identifying the active fluid actuator) generates net fluid flow in a direction from vertex 3 to vertex 5, as indicated by the net flow direction arrow. At vertex 5 the flow of fluid divides and follows different directions through network channels extending from vertex 5 to vertices 1, 2 and 4. Thereafter, the fluid flows back to vertex 3 from vertices 1, 2 and 4, as indicated by the net flow direction arrows. Thus, the selective activation of the single fluid pump actuator 202 near vertex 3 as shown in flow pattern A results in a particular directional flow of fluid throughout the network.

By contrast, the selective activations of other individual fluid pump actuators 202 as shown in flow patterns B, C and D, result in entirely different directional fluid flows through the network 103. For example, referring to network 103 of FIG. 5 exhibiting fluid flow pattern B, the active fluid actuator 202 generates net fluid flow in a direction from vertex 1 to vertex 5, as indicated by the net flow direction arrow. At vertex 5 the flow of fluid divides and follows different directions through network channels extending from vertex 5 to vertices 2, 3 and 4. Thereafter, the fluid flows back to vertex 1 from vertices 2, 3 and 4, as indicated by the net flow direction arrows. Different directional fluid flows apply similarly to the flow patterns C and D. Accordingly, a programmable controller 106 in a microfluidic system 100 can readily adjust fluid flow patterns within a particular network 103 of a microfluidic device 102 through the selective activation of a single fluid pump actuator 202 within the network.

FIG. 6 shows an example of a closed, two-dimensional fluidic network 103 illustrating fluid flow patterns (E, F, G, H, I, J) generated by different pump activation regimes through selective activation of two fluid pump actuators 202 simultaneously within the network 103, according to an embodiment of the disclosure. The two-dimensional network 103 is the same as shown in FIG. 5, and has four fluid pump actuators 202 with eight network channels (or edges) separated by five vertices or channel intersections (referenced as 1, 2, 3, 4, 5). The selective activation of two fluid pump actuators 202 simultaneously as shown in the fluid flow patterns (E, F, G, H, I, J) results in particular directional fluid flows through the network 103 that vary for each pattern.

Referring to network 103 of FIG. 6 exhibiting fluid flow pattern E, for example, the active fluid actuators 202 generate net fluid flow in directions from vertices 2 and 3 to vertex 5, as indicated by the net flow direction arrows. At vertex 5 the flow of fluid divides and follows different directions through network channels extending from vertex 5 to vertices 1 and 4. Thereafter, the fluid flows back to vertices 2 and 3 from vertices 1 and 4, as indicated by the net flow direction arrows. Note that there is no net fluid flow in network channels between vertices 1 and 4, and vertices 2 and 3. Thus, the selective activation of two fluid pump actuators 202 near vertices 2 and 3 simultaneously as shown in the fluid flow pattern E results in particular directional flow of fluid throughout the network. For each of the other fluid flow patterns shown in FIG. 6, different directional fluid flows are generated as indicated by the net flow direction arrows in each pattern. Thus, a programmable controller 106 in a microfluidic system 100 can readily adjust fluid flow patterns within a particular network 103 of a microfluidic device 102 through the selective activation of a two fluid pump actuators 202 simultaneously within the network.

FIG. 7 shows an example of a closed, two-dimensional fluidic network 103 illustrating fluid flow patterns (K, L, M, N) generated by different pump activation regimes through selective activation of three fluid pump actuators 202 simultaneously within the network 103, according to an embodiment of the disclosure. The two-dimensional network 103 is the same as shown in FIG. 5, and has four fluid pump actuators 202 with eight network channels (or edges) separated by five vertices or channel intersections (referenced as 1, 2, 3, 4, 5). The selective activation of three fluid pump actuators 202 simultaneously as shown in the fluid flow patterns (K, L, M, N) results in particular directional fluid flows through the network 103 that vary for each pattern.

Referring to network 103 of FIG. 7 exhibiting fluid flow pattern K, for example, the active fluid actuators 202 generate net fluid flow in directions from vertices 1, 2 and 3, through vertex 5, and on to vertex 4, as indicated by the net flow direction arrows. At vertex 4 the flow of fluid divides and follows different directions through network channels extending from vertex 4 to vertices 1 and 3. Fluid reaching vertices 1 and 3 divides again and flows in different directions to vertices 5 and 2, as indicated by the net flow direction arrows. Thus, the selective activation of three of the four fluid pump actuators 202 near vertices 1, 2 and 3, simultaneously, as shown in the fluid flow pattern K results in particular directional flow of fluid throughout the network 103. For each of the other fluid flow patterns shown in FIG. 7, different directional fluid flows are generated as indicated by the net flow direction arrows in each pattern. The various fluid flow patterns can be implemented in the network of a microfluidic device 102 through selective activation of fluid actuators 202 by a programmable controller 106.

Figure 8:
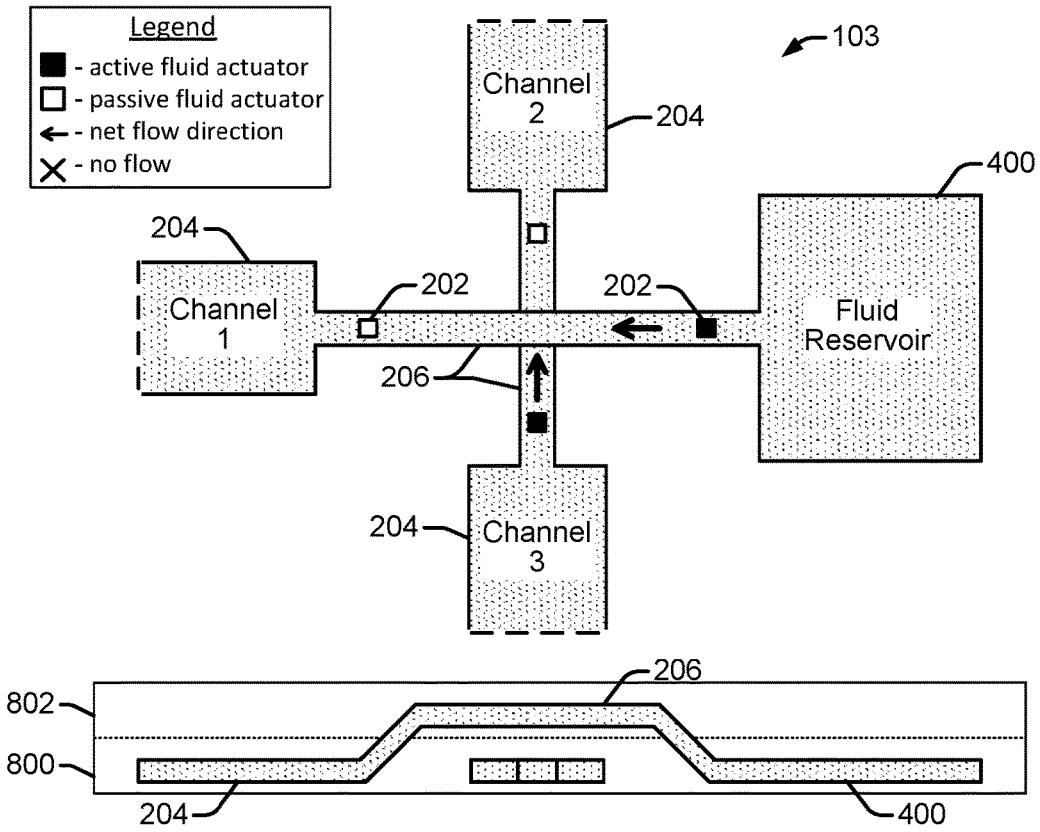
FIG. 8 shows a top down view and corresponding cross-sectional view of an example of an open, bidirectional, three-dimensional fluidic network, according to an embodiment.

As noted above, networks 103 within a microfluidic device 102 may have one-dimensional, two-dimensional, or three-dimensional topologies. FIG. 8 shows a top down view and corresponding cross-sectional view of an example of an open, bidirectional, three-dimensional fluidic network 103, according to an embodiment of the disclosure. The open fluidic network 103 is connected to a fluidic reservoir 400 and facilitates fluid flow in three dimensions with a fluid channel crossing over another fluid channel. Such networks can be fabricated, for example, using conventional microfabrication techniques and a multilayer SU8 technology such as wet film spin coating and/or dry film lamination. SU8 is a transparent photoimageable polymer material commonly used as a photoresist mask for fabrication of semiconductor devices. As shown in FIG. 8, for example, the fluidic reservoir 400 and network channels 1, 2 and 3, can be fabricated in a first SU8 layer. A second SU8 layer 802 can then be used to route fluidic channels over other channels to avoid unwanted channel intersections within the network. Such three-dimensional topologies enable complex and versatile microfluidic networks having integrated inertial pumps within microfluidic devices.

Figure 9:
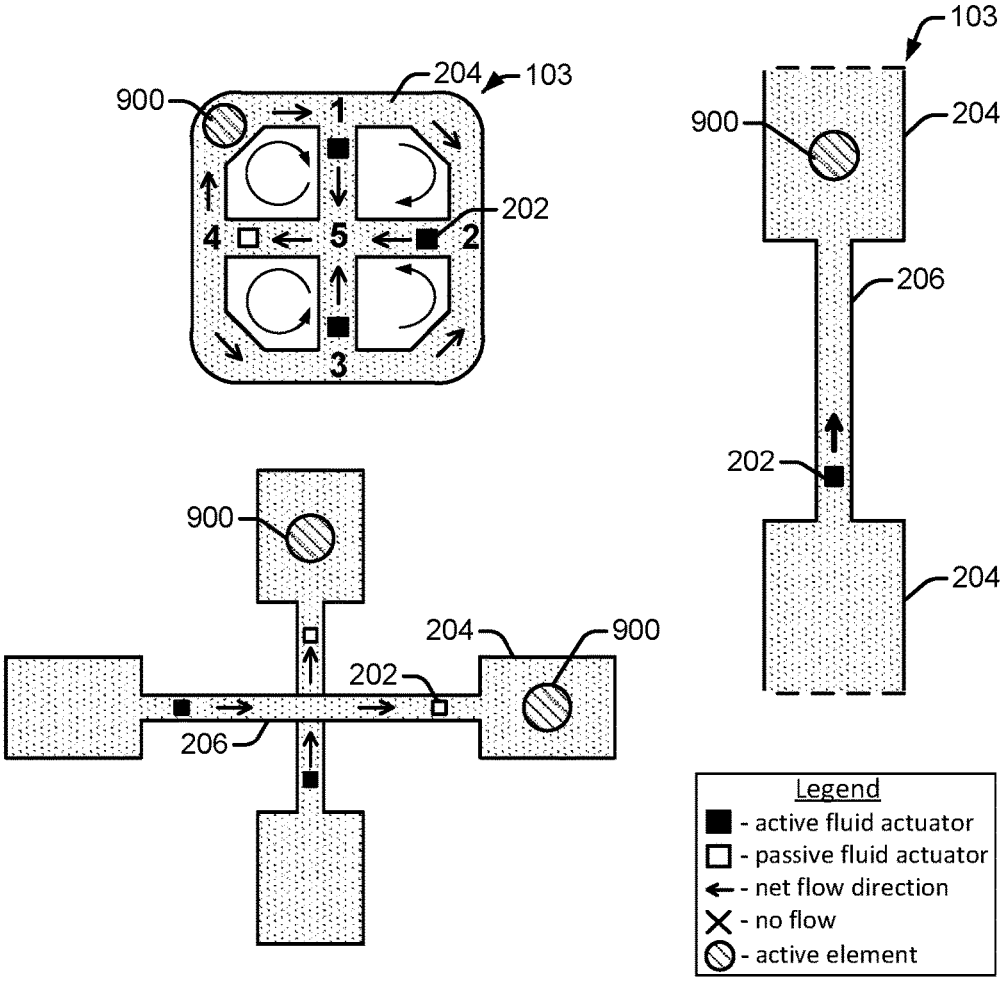
FIG. 9 shows examples of fluidic networks incorporating both fluid pump actuators and active elements, according to some embodiments.

The usefulness of microfluidic devices 102 is enhanced significantly by the integration of various active and passive elements used for analysis, detection, heating, and so on. Examples of such integrated elements include resistive heaters, Peltier coolers, physical, chemical and biological sensors, light sources, and combinations thereof. FIG. 9 shows examples of several fluidic networks 103 incorporating both fluid pump actuators 202 and active elements 900. Each of the fluidic networks discussed herein is suitable for incorporating such integrated elements 900 in addition to fluid pump actuators that provide a variety of fluid flow patterns within the networks.

Although specific fluidic networks have been illustrated and discussed, the microfluidic devices 102 and systems contemplated herein can implement many other fluidic networks having a wide variety of layouts in one, two, and three dimensions, that include a multiplicity of configurations of integrated fluid pump actuators and other active and passive elements.

As previously noted, the pumping effect of a fluidic pump actuator 202 depends on an asymmetric placement of the actuator within a fluidic channel (e.g., within a pump channel 206) whose width is narrower than the width of the reservoir or other channel (such as a network channel 204) from which fluid is being pumped. (Again, a pump channel may itself be a network channel that pumps fluid, for example, between wider fluid reservoirs). The asymmetric placement of the fluid actuator 202 to one side of the center point of a fluidic channel establishes a short side of the channel and a long side of the channel, and a unidirectional fluid flow can be achieved in the direction from the short side (i.e., where the fluid actuator is located) to the long side of the channel. A fluid pump actuator placed symmetrically within a fluidic channel (i.e., at the center of the channel) will generate zero net flow. Thus, the asymmetric placement of the fluid actuator 202 within the fluidic network channel is one condition that needs to be met in order to achieve a pumping effect that can generate a net fluid flow through the channel.

However, in addition to the asymmetric placement of the fluid actuator 202 within the fluidic channel, another component of the pumping effect of the fluid actuator is its manner of operation. Specifically, to achieve the pumping effect and a net fluid flow through the channel, the fluid actuator should also operate asymmetrically with respect to its displacement of fluid within the channel. During operation, a fluid actuator in a fluidic channel deflects, first in one direction and then the other (such as with a flexible membrane or a piston stroke), to cause fluid displacements within the channel. As noted above, a fluid actuator 202 generates a wave propagating in the fluidic channel that pushes fluid in two opposite directions along the channel. If the operation of the fluid actuator is such that its deflections displace fluid in both directions with the same speed, then the fluid actuator will generate zero net fluid flow in the channel. To generate net fluid flow, the operation of the fluid actuator should be configured so that its deflections, or fluid displacements, are not symmetric. Therefore, asymmetric operation of the fluid actuator with respect to the timing of its deflection strokes, or fluid displacements, is a second condition that needs to be met in order to achieve a pumping effect that can generate a net fluid flow through the channel.

Figure 10:
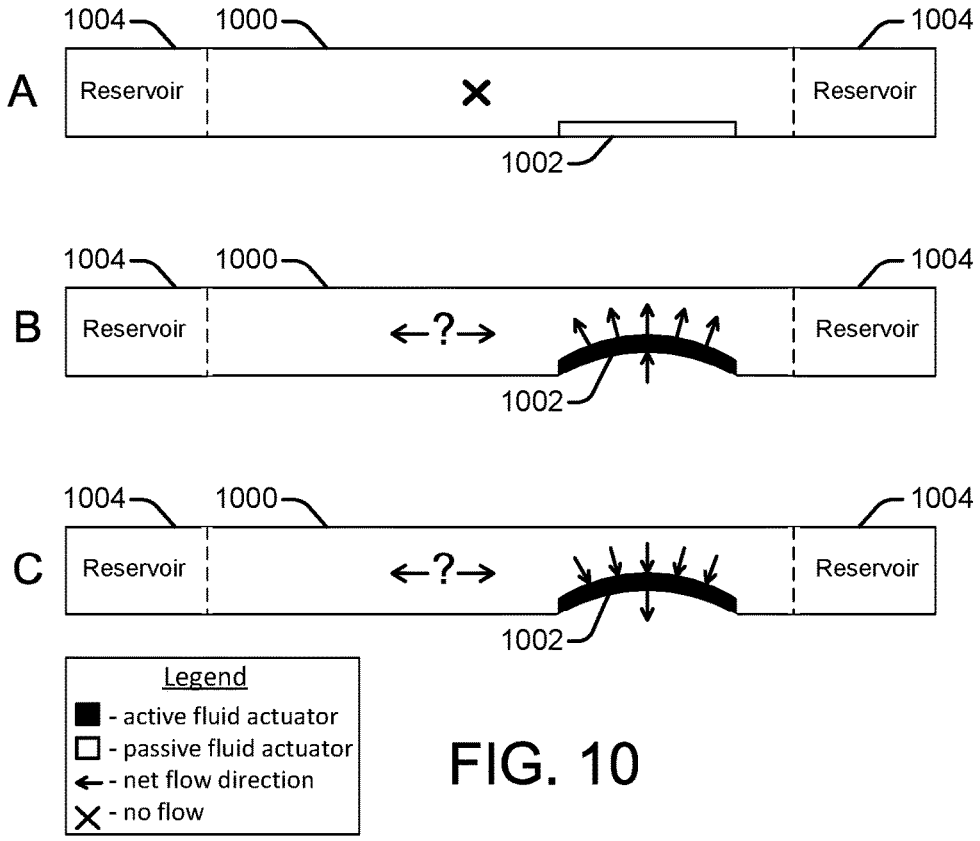
FIG. 10 shows a side view of an example fluidic network channel with an integrated fluid pump actuator in different stages of operation, according to an embodiment.

FIG. 10 shows a side view of an example fluidic network channel 1000 with an integrated fluid pump actuator 1002 in different stages of operation, according to an embodiment of the disclosure. Fluidic reservoirs 1004 are connected at each end of the channel 1000. The integrated fluid actuator 1002 is asymmetrically placed at the short side of the channel near an input to a fluidic reservoir 1004, satisfying the first condition needed to create a pumping effect that can generate a net fluid flow through the channel. The second condition that needs to be satisfied to create a pump effect is an asymmetric operation of the fluid actuator 1002, as noted above. The fluid actuator 1002 is generally described herein as being a piezoelectric membrane whose up and down deflections (sometimes referred to as piston strokes) within the fluidic channel generate fluid displacements that can be specifically controlled. However, a variety of other devices can be used to implement the fluid actuator including, for example, a resistive heater to generate a vapor bubble, an electrostatic (MEMS) membrane, a mechanical/impact driven membrane, a voice coil, a magneto-strictive drive, and so on.

At operating stage A shown in FIG. 10, the fluid actuator 1002 is in a resting position and is passive, so there is no net fluid flow through the channel 1000. At operating stage B, the fluid actuator 1002 is active and the membrane is deflected upward into the fluidic channel 1000. This upward deflection, or forward stroke, causes a compressive displacement of fluid within the channel 1000 as the membrane pushes the fluid outward. At operating stage C, the fluid actuator 1002 is active and the membrane is beginning to deflect downward to return to its original resting position. This downward deflection, or reverse stroke, of the membrane causes a tensile displacement of fluid within the channel 1000 as it pulls the fluid downward. An upward and downward deflection is one deflection cycle. A net fluid flow is generated through the channel 1000 if there is temporal asymmetry between the upward deflection (i.e., the compressive displacement) and the downward deflection in repeating deflection cycles. Since temporal asymmetry and net fluid flow direction are discussed below with reference to FIGS. 11-14, FIG. 10 includes question marks inserted between opposite net flow direction arrows for the operating stages B and C. These question marks are intended to indicate that the temporal asymmetry between the compressive and tensile displacements has not been specified and therefore the direction of flow, if any, is not yet known.

Figure 11:
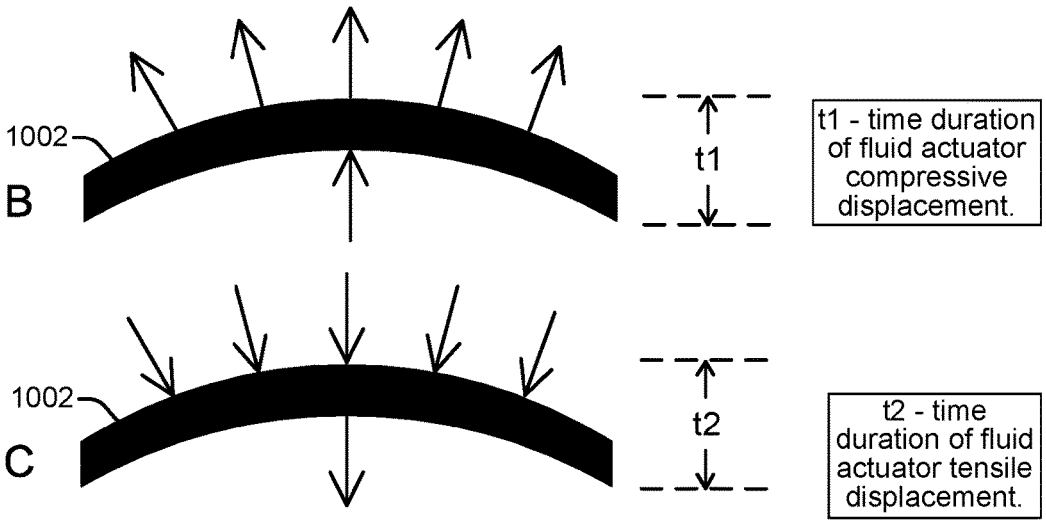
FIG. 11 shows the active fluid actuator at the operating stages from FIG. 10, according to an embodiment.

FIG. 11 shows the active fluid actuator 1002 at the operating stages B and C from FIG. 10, along with time markers "t1" and "t2" to help illustrate temporal asymmetry between compressive and tensile displacements generated by the fluid actuator 1002, according to an embodiment of the disclosure. The time t1 is the time it takes for the fluid actuator membrane to deflect upward, generating a compressive fluid displacement. The time t2 is the time it takes for the fluid actuator membrane to deflect downward, or back to its original position, generating a tensile fluid displacement. Asymmetric operation of the fluid actuator 1002 occurs if the t1 duration of the compressive displacement (upward membrane deflection) is greater or lesser than (i.e., not the same as) the t2 duration of the tensile displacement (downward membrane deflection). Such asymmetric fluid actuator operation over repeating deflection cycles generates a net fluid flow within the channel 1000. However, if the t1 and t2 compressive and tensile displacements are equal, or symmetric, there will be little or no net fluid flow through the channel 1000, regardless of the asymmetric placement of the fluid actuator 1002 within the channel 1000.

Figure 12:
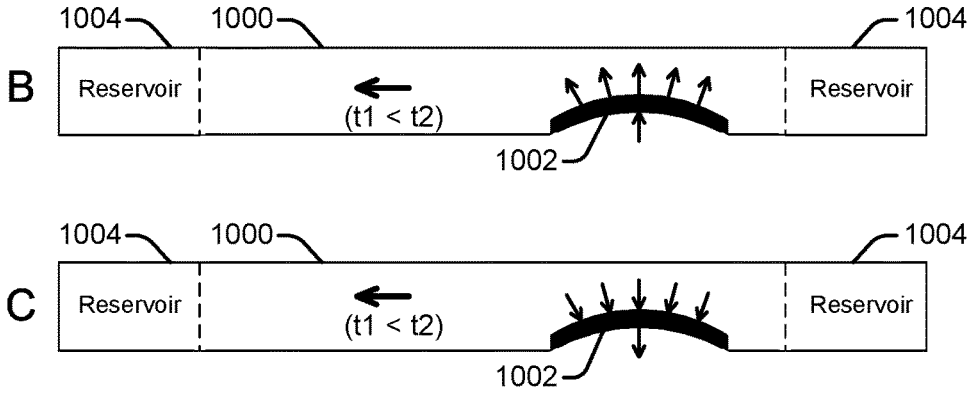
FIGS. 12, 13 and 14 show the active fluid actuator at the operating stages from FIG. 10, including net fluid flow direction arrows, according to some embodiments.
Figure 13:
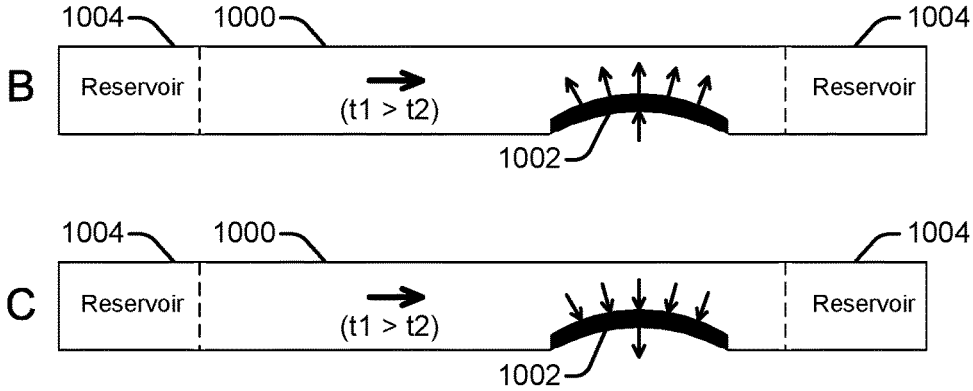
Figure 14:
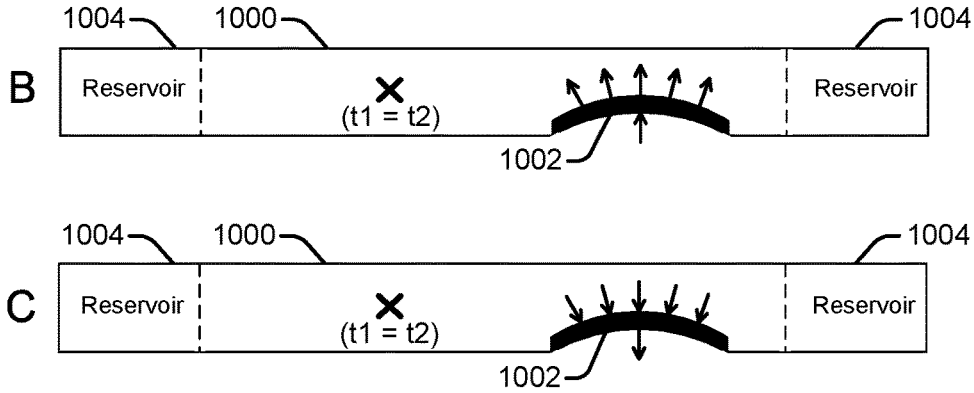
Figure 15:
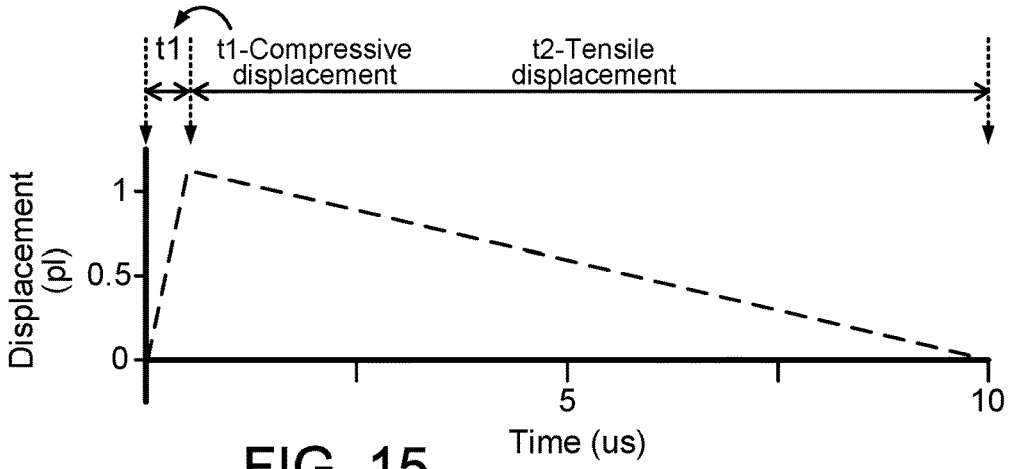
FIGS. 15, 16 and 17 show example displacement pulse waveforms, according to some embodiments.
Figure 16:
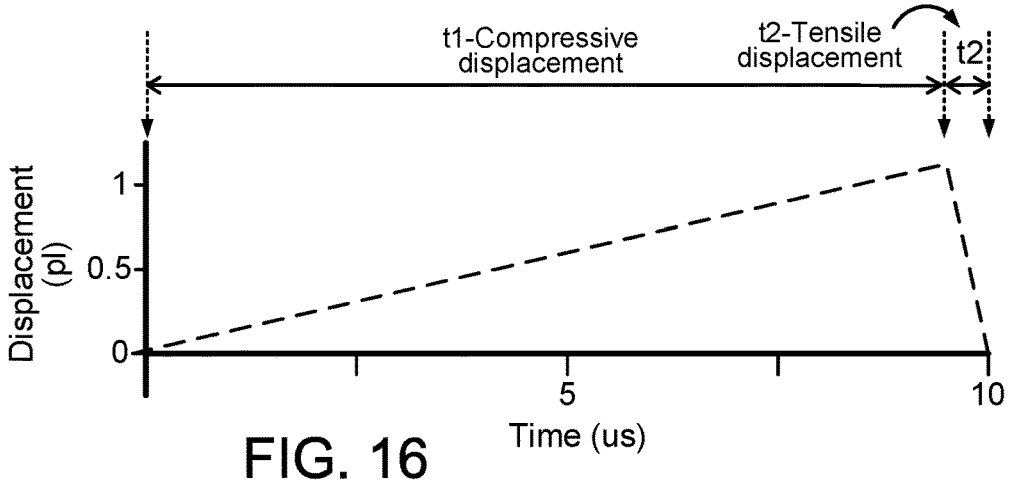
Figure 17:
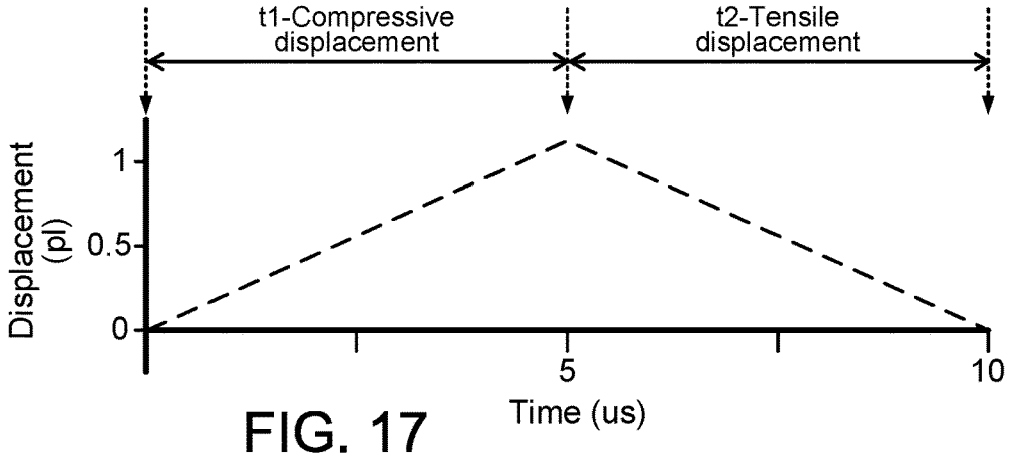

FIGS. 12, 13 and 14 show the active fluid actuator 1002 at the operating stages B and C from FIG. 10, including net fluid flow direction arrows that indicate which direction fluid flows through the channel 1000, if at all, according to embodiments of the disclosure. The direction of the net fluid flow depends on the compressive and tensile displacement durations (t1 and t2) from the actuator. FIGS. 15, 16 and 17 show example displacement pulse waveforms whose durations correspond respectively with the displacement durations t1 and t2 of FIGS. 12, 13 and 14. For various fluid pump actuators the compressive displacement and tensile displacement times, t1 and t2, can be precisely controlled by a controller 106, for example, executing instructions such as from module 112 (the fluid actuator asymmetric operation module 112) within a microfluidic system 100.

Referring to FIG. 12, the compressive displacement duration, t1, is greater than the tensile displacement duration, t2, so there is a net fluid flow in a direction from the short side of the channel 1000 (i.e., the side where the actuator is located) to the long side of the channel. The difference between the compressive and tensile displacement durations, t1 and t2, can be seen in FIG. 15 which shows a corresponding example displacement pulse waveform that might be generated by the fluid actuator with a compressive displacement duration of t1 and a tensile displacement duration of t2. The waveform of FIG. 15 indicates a displacement pulse/cycle on the order of 1 pico-liter (pl) with the compressive displacement duration, t1, of approximately 0.5 microseconds (ms) and the tensile displacement duration, t2, of approximately 9.5 ms. The values provided for the fluid displacement amount and displacement durations are only examples and not intended as limitations in any respect.

In FIG. 13, the compressive displacement duration, t1, is greater than the tensile displacement duration, t2, so there is a net fluid flow in the direction from the long side of the channel 1000 to the short side of the channel. The difference between the compressive and tensile displacement durations, t1 and t2, can be seen in FIG. 16 which shows a corresponding example displacement pulse waveform that might be generated by the fluid actuator with a compressive displacement duration of t1 and a tensile displacement duration of t2. The waveform of FIG. 16 indicates a displacement pulse/cycle on the order of 1 pico-liter (pl) with the compressive displacement duration, t1, of approximately 9.5 microseconds (ms) and the tensile displacement duration, t2, of approximately 0.5 ms.

In FIG. 14, the compressive displacement duration, t1, is equal to the tensile displacement duration, t2, so there is little or no net fluid flow through the channel 1000. The equal compressive and tensile displacement durations of t1 and t2, can be seen in FIG. 17 which shows a corresponding example displacement pulse waveform that might be generated by the fluid actuator with a compressive displacement duration of t1 and a tensile displacement duration of t2. The waveform of FIG. 17 indicates a displacement pulse/cycle on the order of 1 pico-liter (pl) with the compressive displacement duration, t1, of approximately 5.0 microseconds (ms) and the tensile displacement duration, t2, of approximately 5.0 ms.

Note that in FIG. 14, although there is asymmetric location of the fluid actuator 1002 within the channel 1000 (satisfying one condition for achieving the pump effect), there is still little or no net fluid flow through the channel 1000 because the fluid actuator operation is not asymmetric (the second condition for achieving the pump effect is not satisfied). Likewise, if the location of the fluid actuator was symmetric (i.e., located at the center of the channel), and the operation of the actuator was asymmetric, there would still be little or no net fluid flow through the channel because both of the pump effect conditions would not be satisfied.

From the above examples and discussion of FIGS. 10-17, it is significant to note the interaction between the pump effect condition of asymmetric location of the fluid actuator and the pump effect condition of asymmetric operation of the fluid actuator. That is, if the asymmetric location and the asymmetric operation of the fluid actuator work in the same direction, the fluid pump actuator will demonstrate a high efficiency pumping effect. However, if the asymmetric location and the asymmetric operation of the fluid actuator work against one another, the asymmetric operation of the fluid actuator reverses the net flow vector caused by the asymmetric location of the fluid actuator, and the net flow is from the long side of the channel to the short side of the channel 1000.

In addition, from the above examples and discussion of FIGS. 10-17, it can now be better appreciated that the fluid pump actuator 202 discussed above with respect to the microfluidic networks 103 of FIGS. 2-8 is assumed to be an actuator device whose compressive displacement is greater that its tensile displacement. An example of such an actuator is a resistive heating element that heats the fluid and causes displacement by an explosion of supercritical vapor. Such an event has an explosive asymmetry whose expansion phase (i.e., compressive displacement) is faster than its collapse phase (i.e., tensile compression). The asymmetry of this event cannot be controlled in the same manner as the asymmetry of deflection caused by a piezoelectric membrane actuator, for example.

Figure 18:
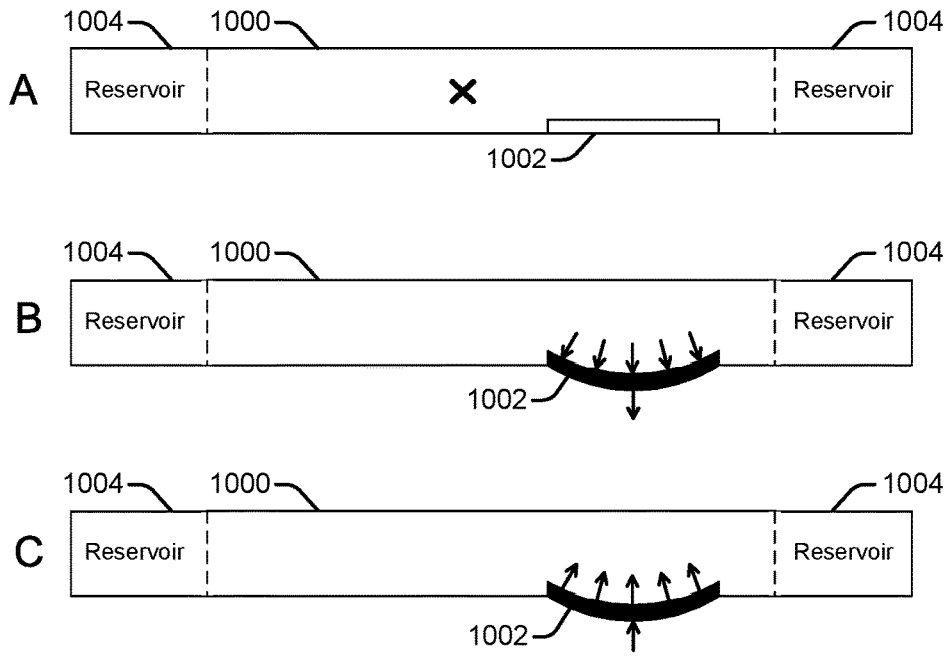
FIG. 18 shows a side view of an example fluidic network channel with an integrated fluid pump actuator in different stages of operation, according to an embodiment.

FIG. 18 shows a side view of an example fluidic network channel 1000 with an integrated fluid pump actuator 1002 in different stages of operation, according to an embodiment of the disclosure. This embodiment is similar to that shown and discussed regarding FIG. 10 above, except that the deflections of the fluid actuator membrane are shown working differently to create compressive and tensile displacements within the channel 1000. At operating stage A shown in FIG. 18, the fluid actuator 1002 is in a resting position and is passive, so there is no net fluid flow through the channel 1000. At operating stage B, the fluid actuator 1002 is active and the membrane is deflected downward and outside of the fluidic channel 1000. This downward deflection of the membrane causes a tensile displacement of fluid within the channel 1000, as it pulls the fluid downward. At operating stage C, the fluid actuator 1002 is active and the membrane is beginning to deflect upward to return to its original resting position. This upward deflection causes a compressive displacement of fluid within the channel 1000, as the membrane pushes the fluid upward into the channel. A net fluid flow is generated through the channel 1000 if there is temporal asymmetry between the compressive displacement and the tensile displacement. The direction of a net fluid flow is dependent upon the durations of the compressive and tensile displacements, in the same manner as discussed above.

What is claimed is:

1. A microfluidic system comprising a network of microfluidic channels comprising at least three loops interconnected at a junction, each of the loops comprising:

a fluid channel having a length extending from the junction to a distal end; and a fluid actuator along the fluid channel and located at a first distance from the junction along the length of the fluid channel and at a second distance less than the first distance from the distal end, wherein the fluid actuator of each of the loops generate first and second waves, respectively, propagating toward the junction and the distal end of the respective channel, wherein the fluid actuators of the loops cooperate to selectively produce net fluid flow in different directions about the loops.

2. The microfluidic system of claim 1, wherein the at least three loops comprise:

a first loop;

a second loop;

a third loop; and a fourth loop, wherein outer portions of the first loop, the second loop, the third loop and the fourth loop are connected to form an outer loop connected to and surrounding each of the fluid channels of the first loop, the second loop, the third loop and the fourth loop.

3. The microfluidic system of claim 2, wherein the length of the fluid channel of each of the first loop, the second loop, the third loop and the fourth loop extends from the junction to the outer loop.

4. The microfluidic system of claim 2, wherein the fluid channels of the first loop and the second loop extend perpendicular to the fluid channels of the third loop and the fourth loop.

5. The microfluidic system of claim 2, wherein fluid channel of the first loop and the second loop extend opposite one another on opposite sides of the junction.

6. The microfluidic system of claim 1, wherein the fluid channel of at least two of the at least three loops extend opposite one another on opposite sides of the junction.

7. The microfluidic system of claim 1 further comprising at least one of the resistive heater, a Peltier cooler, the physical sensor, chemical sensor, a biological sensor, a light source or a combination thereof along a perimeter of one of the at least three loops.

8. The microfluidic system of claim 1 further comprising a controller to selectively activate the fluid actuator of each of the at least three loops to selectively initiate a first net unidirectional fluid flow about one of the at least three loops or a second net unidirectional flow, opposite the first net unidirectional flow, about said one of the at least three loops.

9. A method comprising:

supplying a liquid to a network of microfluidic channels comprising at least three loops interconnected at a junction, each of the loops comprising:

a fluid channel having a length extending from the junction to a second end; and a fluid actuator along the fluid channel and located at a first distance from junction along the length of the fluid channel and at a second distance less than the first distance from the second end; and activating the fluid actuator of selected ones of the at least three loops to selectively produce net fluid flow in different directions about the loops.

10. The method of claim 9 further comprising activating the fluid actuator of selected ones of the at least three loops to inhibit net fluid flow completely about at least one of the at least three loops.

11. The method of claim 9, wherein the fluid actuator of selected ones of the at least three loops are activated to produce a net fluid flow about one of the loops to a resistive heater, a Peltier cooler, a physical sensor, a chemical sensor, a biological sensor, a light source and combinations thereof located along one of the loops.

12. The method of claim 9, wherein the at least three loops comprise:

a first loop;

a second loop;

a third loop; and a fourth loop, wherein outer portions of the first loop, the second loop, the third loop and the fourth loop are connected to form an outer loop connected to and surrounding each of the fluid channels of the first loop, the second loop, the third loop and the fourth loop.

* * * * *